US008052540B2

(12) United States Patent
Loh

(10) Patent No.: US 8,052,540 B2
(45) Date of Patent: Nov. 8, 2011

(54) PUTTING TRAINER

(76) Inventor: James Cheng-Wah Loh, San Gabriel, CA (US)

( * ) Notice: Subject to any disclaimer, the term of this patent is extended or adjusted under 35 U.S.C. 154(b) by 0 days.

(21) Appl. No.: 12/861,066

(22) Filed: Aug. 23, 2010

(65) Prior Publication Data

US 2011/0151985 A1 Jun. 23, 2011

Related U.S. Application Data

(60) Provisional application No. 61/284,568, filed on Dec. 22, 2009.

(51) Int. Cl.
*A63B 69/36* (2006.01)

(52) U.S. Cl. ..... 473/222; 473/226; 473/257

(58) Field of Classification Search ..... 473/219–226, 473/257, 266, 268, 278
See application file for complete search history.

(56) References Cited

U.S. PATENT DOCUMENTS

| | | | | |
|---|---|---|---|---|
| 3,727,919 | A * | 4/1973 | Scott | 473/240 |
| 4,921,660 | A * | 5/1990 | Kryter | 473/252 |
| 5,042,814 | A * | 8/1991 | Bennett | 473/225 |
| 6,702,690 | B1 * | 3/2004 | Albright | 473/265 |
| 7,465,237 | B1 * | 12/2008 | Shoemaker | 473/265 |
| 7,815,516 | B1 * | 10/2010 | Mortimer et al. | 473/257 |
| 2001/0017347 | A1 * | 8/2001 | Blankenship | 250/221 |
| 2006/0014589 | A1 * | 1/2006 | Kim | 473/233 |

* cited by examiner

*Primary Examiner* — Nini Legesse
(74) *Attorney, Agent, or Firm* — Clement Cheng

(57) ABSTRACT

A putting trainer has a long strip mounted to the head along a length of the putter head. The long strip has a pair of ends, namely a close end toward the player and a far end away from a player. The putting trainer has a ball path having a pair of columns of sensors, namely a column of right sensors and a column of left sensors. The pair of columns of sensors detect the motion of the long strip over the pair of columns of sensors. An audio output from a speaker provides feedback to the player. A golf trainer also includes a golf putter having a handle, a shaft connected to the handle, a hosel connected to the shaft and a putter head connected to the hosel.

13 Claims, 11 Drawing Sheets

PUTTING TRAINER

This application claims priority from provisional application filed the Dec. 22, 2009 for application Ser. No. 61/284,568 entitled Putting Trainer by inventor James Cheng-Wah Loh, the disclosure of which is incorporated herein by reference.

FIELD OF THE INVENTION

The present invention is in the field of putting trainers.

DISCUSSION OF RELATED ART

A variety of putting trainers have been made for improving golf putting skills of golf players. Putting trainers generally include a wide variety of different apparatus for helping and training players. For example, U.S. Pat. No. 6,503,152 to Pelz, describes a putting trainer having a number of grooves for teaching proper alignment of a clubhead relative to a golf ball. Another example of a golf putting trainer is shown in U.S. Pat. No. 4,826,174 to Hoyt Jr., the disclosure of which is incorporated herein by reference. Hoyt discloses a putting station and remote target station with multiple parallel rows of posts that serve as guides for the putting head. A wide variety of visual guides are helpful for teaching putting to the novice golf player.

SUMMARY OF THE INVENTION

The putting trainer is structurally made with a long strip mounted to the head along a length of the putter head. The long strip has a pair of ends, namely a close end toward the player and a far end away from a player. The putting trainer has a ball path having a pair of columns of sensors, namely a column of right sensors and a column of left sensors. The pair of columns of sensors detect the motion of the long strip over the pair of columns of sensors. An audio output from a speaker provides feedback to the player. A golf trainer also includes a golf putter having a handle, a shaft connected to the handle, a hosel connected to the shaft and a putter head connected to the hosel.

The long strip is mounted to the golf putter at a rear slot formed on a rear surface of a putter head. The long strip fits into the rear slot and is removably secured within the rear slot. The long strip is formed with a rectangular cross-section so that the long strip is bar shaped.

The long strip has a pair of outwardly facing horizontally oriented long strip vertical members mounted at a left and right end of the long strip, and the pair of columns of sensors is vertically oriented and mounted on a horizontal surface. The pair of columns of sensors senses the pair of outwardly facing horizontally oriented long strip vertical members when the pair of outwardly facing horizontally oriented long strip vertical members pass the pair of columns of sensors. Optionally, long strip plug of the same length as the putter head, and flush with the putter head when the long strip plug replaces the long strip. Optionally, the pair of outwardly facing vertical oriented long strip horizontal members are preferably flag shaped.

The long strip can also be is mounted to the golf putter at a top slot formed on a top surface of a putter head, wherein the top strip fits into the top slot and is removably secured within the top slot. In this case, the long strip is formed with a rectangular cross-section so that the long strip is bar shaped. The long strip again has a pair of outwardly facing horizontally oriented long strip vertical members mounted at a left and right end of the long strip, and the pair of columns of sensors is vertically oriented and mounted on a horizontal surface, so that the pair of columns of sensors senses the pair of outwardly facing horizontally oriented long strip vertical members when the pair of outwardly facing horizontally oriented long strip vertical members pass the pair of columns of sensors. Here, a long strip plug of the same length as the putter head can be flush with the putter head when the long strip plug replaces the long strip. The pair of outwardly facing vertical oriented long strip horizontal members are preferably flag shaped.

The putting trainer long strip can also be formed with a round cross-section so that the long strip is rod shaped, and the long strip is mounted to the golf putter at a rod retainer opening passing through the putter head. The long strip has a pair of outwardly facing vertical oriented long strip horizontal members mounted at a left and right end of the long strip, and the pair of columns of sensors is horizontally oriented and mounted on a vertical surface, so that the pair of columns of sensors senses the pair of outwardly facing vertical oriented long strip horizontal members when the pair of outwardly facing vertically oriented long strip horizontal members pass the pair of columns of sensors. Optionally, a rod extension plug of the same length as the putter head can be made flush with the putter head when the rod extension plug replaces the long strip in the rod retainer opening. The pair of outwardly facing vertical oriented long strip horizontal members are preferably disk shaped.

The long strip can also be secured and mounted to the golf putter by hook and loop tape to a top surface of the putter head for removable configuration. Optionally, the long strip can be mounted to the golf putter by a clamp that clamps to the hosel of the putter head. Preferably, clamp is mounted on a long strip post, so that the long strip post is mounted to the long strip and extends vertically from the long strip in an upward direction. The long strip can be mounted to the golf putter by a clamp that clamps to the hosel of the putter head, if the clamp is mounted to the long strip.

This present invention is a method of using musical feedback to train a golf putt. The present invention provides a strip or stick of proper length and shape to be located at or attached to the top or side surfaces of the putter head as shown to detect the speed and orientation of the putter face at the contact with the golf ball. The purpose of the long strip or stick hanging on or attached to the side surface of the putter head is to lay close to the same level as the golf ball placed on the ground, assuming the collision between the strip or stick and the sensors can be avoided. When the club head is moving along the target line to drive the golf ball toward the target, the two end sections of the strip or stick will trigger the pairs of electronic sensors, such as the photoelectric sensors, placed at properly chosen locations around the golf ball. The triggered sensors will produce some audio or visual signals which will provide information about the speed and orientation of the putter face moving in the middle of each pair of sensors. The pattern formed by the audio signals, such as musical notes, or a musical melody, is related to the speed and the orientation of the putter head in the segment of the putting head path where those sensors are located. The sensors, golf ball and golf club therefore become a musical instrument which output from speakers sound which is a musical melody so that the user can remember and associate a particular musical melody with a particular stroke.

The tempo of the sound pattern is proportional to the speed of the hit golf ball, assuming the ground is relatively flat. The target line is the line connecting the golf ball and the target.

The connecting lines of each pair of sensors are perpendicular to the target line and separated by equal distance. The golf ball is placed on the target line and located at or close to the midpoint of a pair of striking row sensors. The audio signals sent by the pair of the striking row sensors such as the two sensors SR3 and SL3 provide information about the orientation of the putter face at the contact between the putter head and the golf ball. Also the lines (such as Line 1, Line 2, Line 3, Line 4, Line 5 and Line 6) connecting the $1^{st}$, $2^{nd}$, $3^{rd}$, $4^{th}$, $5^{th}$ and $6^{th}$ pair of sensors can be used to show the orientation of the putter head face when the clubface crosses those lines. The golf ball is placed at such a spot that when the clubface meets the golf ball, the two elevated end sections of the long strip will pass over the two sensors SR3 and SL3. If the attached strip whose length is parallel to the putter face covers up the time connecting the pair of striking sensors such as the Line 3 connecting the sensor SR3 and sensor SL3 at the contact between the putter head and the golf ball, then the putter face is square with the target line and the golf ball will move along the target line toward the target. In this case the audio signals sent by the two sensors SR3 and SL3 will sound simultaneously as one combined sound signal, for example in the form of two musical notes that merge in time.

Because an extra weight of the strip or stick plus the connecting tool is added to the putter head, when the golfer starts putting on the golf green without the help of the strip or stick, an extra small piece of weight equal to the weight of strip or stick plus the connecting tool will be attached to the putter at the proper place so that there will be no change in swing inertia at the putter head felt by the golfer. The strip or stick and the connecting tool will be made as light as possible so that the change of swing inertia will be minimized between the putter equipped with the stick or strip and the bare putter.

In order to save time in retrieving the golf ball and save the space for putting practice, a block of reflective wall is placed in front of the golf ball to bounce the ball back to the golfer. If the golfer can consistently putt the ball to the rebounding wall and have it bounce back to his/her feet for varying distances between the golfer and the rebounding wall in practice, then the golfer is maintaining a good control of both the orientation and the speed of the golf ball. The pace of the golf ball is related to a) the distance between the rebounding wall and the golfer, and b) the bouncing property or capability of the rebounding wall. If the golfer wants to practice putting at a slower pace, he/she can bring the rebounding wall closer or use a highly reflective material or coil spring so that the golfer will putt at a slower pace to bring the ball back to its starting point. On the other hand, a longer distance or lower rebounding wall will help faster putting practice. Also, if there is limited space available, a lower rebounding wall can be used to return a high speed ball to its starting point. A bounce block may have at least two faces, namely a first face, a second face. The first face has high bounce back surface, and a second face with a low bounce back surface. There can be four rebounding walls on a block.

OBJECTS OF THE INVENTION

Accordingly several advantages and objects of the present invention are:

A principal object of the present invention is to provide a long strip or stick located around or attached to the top or side surface with the length of the strip or stick parallel to the putter face. By observing the variation of the orientation and speed of the long strip or stick in a segment of the putter head path around the golf ball, the golfer will know the variation of the orientation and speed of the putter face in the segment of the putting stroke. The attachment means may vary depending on the structure and material of the putter. In general the long strip or stick is attached to the putter on the top or side surface of the putter so that the strip or stick will be located close to the ground.

An object of the present invention is to provide two arrays of sensors lined up on both sides of the target line. Two arrays of sensors may be placed on the ground to be triggered by the two enlarged end sections that move above the sensors when the putter head moves along the target line, in order to drive the golf ball back to the target. Two columns of sensors hanging on the wall of the two long blocks may be triggered by the two round disks attached to the two ends of the long stick when the putter head moves along the target line to drive the golf ball to the target.

An object of the present invention is to provide one or more blocks of rebounding reflective wall for the putter to shoot at and retrieve the ball when it bounces back. The rebounding reflective wall is made of different elastic bouncing materials and springs with different bouncing capability. In a small space, for very slow pace putting, a high bouncing material is used. If the putter wishes to practice faster pace in a small space, a very low bouncing material will be used in the rebounding reflective wall.

The following call out list of elements may be useful in referencing elements of the drawings:

20 Long Strip
21 Long Strip Main Level
22 Long Strip Vertical Rise
23 Long Strip Upper Level
24 Securing Openings
25 Set Screws
26 Long Strip Post
27 Post Ball Connector
28 Hosel Clamp
29 Ball Clamp

30 Golf Putter
31 Golf Putter Shaft
32 Hosel
33 Rear Of Putter Head
34 Rear Slot
35 Top Slot
36 Top Of Putter Head
37 Outside Face Of Putter Head
38 Rod Retainer Opening
39 Securing Opening on Top Slot
40 Rod
41 Rod Extension
42 Rod Extension Horizontal Tip Member
43 Rod Extension Plug
44 Long Strip Horizontal Member
45 Long Strip Vertical Tip Member
46 Long Strip Plug
47 Long Strip Prong
48 Long Strip Prong Opening
49 Attachment Point
51 First Right Vertical Sensor
52 Second Right Vertical Sensor
53 Third Right Vertical Sensor
54 Fourth Right Vertical Sensor
55 Fifth Right Vertical Sensor
56 Sixth Right Vertical Sensor
57 Seventh Right Vertical Sensor
58 Eighth Right Vertical Sensor
61 First Left Vertical Sensor
62 Second Left Vertical Sensor
63 Third Left Vertical Sensor
64 Fourth Left Vertical Sensor
65 Fifth Left Vertical Sensor
66 Sixth Left Vertical Sensor
67 Seventh Left Vertical Sensor
68 Eighth Left Vertical Sensor
71 First Right Horizontal Sensor
72 Second Right Horizontal Sensor
73 Third Right Horizontal Sensor
74 Fourth Right Horizontal Sensor
75 Fifth Right Horizontal Sensor
76 Sixth Right Horizontal Sensor
77 Seventh Right Horizontal Sensor
78 Eighth Right Horizontal Sensor
79 Ninth Right Horizontal Sensor
81 First Left Horizontal Sensor
82 Second Left Horizontal Sensor
83 Third Left Horizontal Sensor
84 Fourth Left Horizontal Sensor
85 Fifth Left Horizontal Sensor
86 Sixth Left Horizontal Sensor
87 Seventh Left Horizontal Sensor
88 Eighth Left Horizontal Sensor
89 Ninth Left Horizontal Sensor
95 Median Line
110 Rebound Block
111 First Rebound Block Surface
112 Second Rebound Block Surface
113 Third Rebound Block Surface
114 Fourth Rebound Block Surface
115 Spring Loaded Rebound Block Surface
121 Long Strip First Guide
122 Long Strip Second Guide
123 Hook And Loop Tape
888 Golf Ball

DETAILED DESCRIPTION OF THE PREFERRED EMBODIMENT

Figure 1:
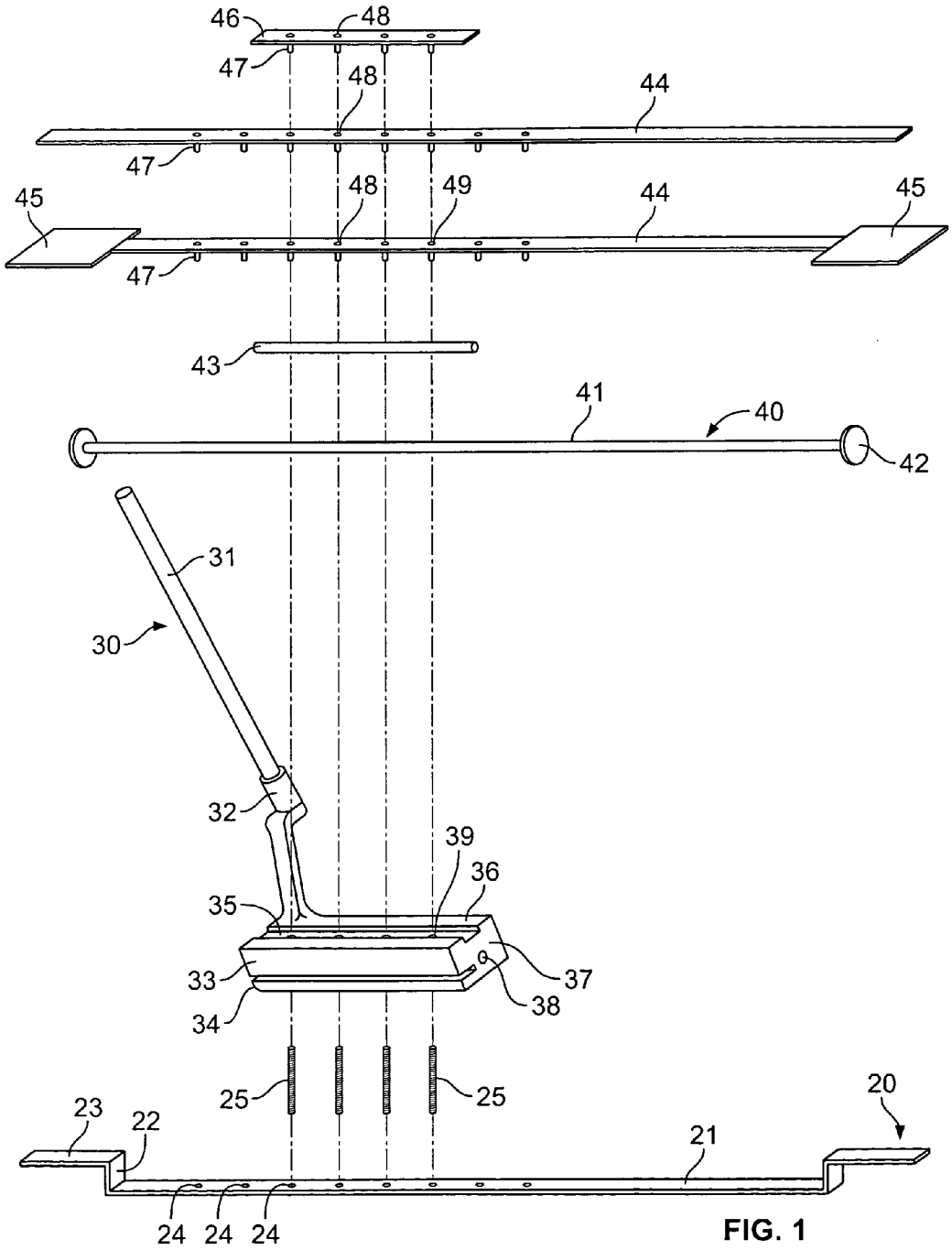
FIG. 1 is an exploded view diagram of the present invention.

FIG. 1 shows an exploded view of a putter of the preferred embodiment. The strip is a stick that can be attached to the putter head. The putter has a number of optional attachments. For example, the long strip 20 may comprise a long strip Main level 21 with a long strip vertical rise 22 and a long strip upper level 23 formed from a bent piece of long strip of metal. The long strip 20 may have a plurality of securing openings 24 for receiving set screws 25. The long strip preferably fits into a slot such as the rear slot 34, or the top slot held by securing openings 39.

Preferably, the long strips 20 are of the same weight as shown in FIG. 1. Each of the four adjacent small pegs under the strip can be formed as long strip prong's 47 extending downward from a lower surface of the long strip plug 46 which preferably extend into the four smaller holes in the groove on the top surface of the putter. Though for smaller holes are the long strip prong openings which are vertically disposed. A total of six optional attachments are shown in the first figure.

A number of set screws 25 can secure the long strip to the putter head. The set screws preferably pass through the openings on the top slot. The openings are adjacent to each other.

The round rod elements, including rod 40, and rod extension plug 43 fit into rod retainer opening 38 seen on the outside face 37 of the putter head. The length of the rod extension plug 43 is preferably the length of the putter head so that the rod extension plug 43 is flush with the outside face of the putter head. The rod extension plug can be of heavier higher density material to provide the same weight as the rod. The rod can be threaded or interference fit so that it sits inside the putter head through the round hole passing through the center of the putter.

Preferably, the different attachments are of the same weight and moment of inertia so that a user would not have to adjust to the difference in weight between practice and normal play.

Figure 2:
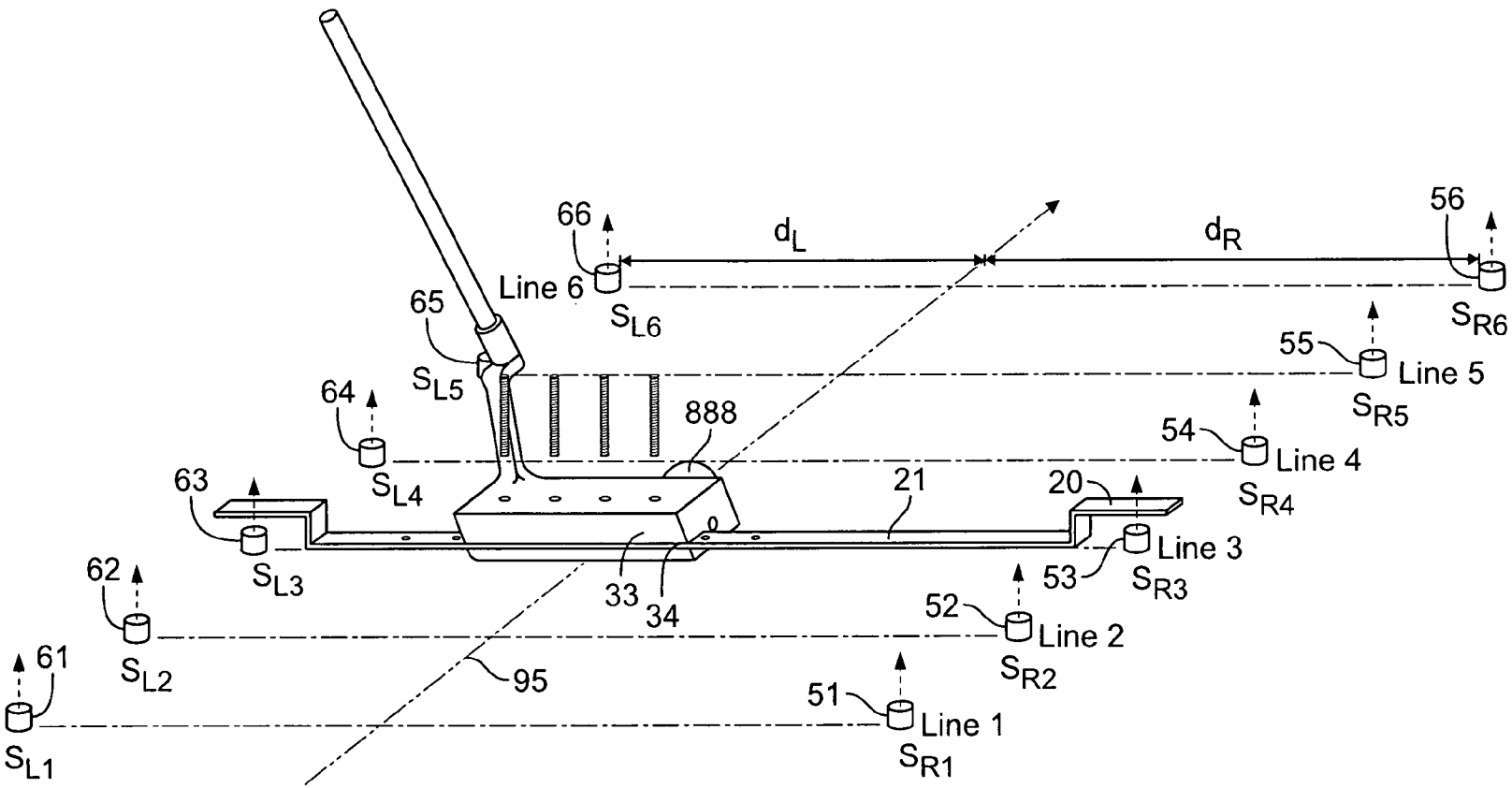
FIG. 2 is a perspective view diagram of the usage of the present invention.

FIG. 2 shows the putter with the long strip main level inserted into the rear slot 34 on the rear of the putter head. The set screws from the top of the putter head extend downward to secure the long strip main level to the slot. The bent end sections of the strip are formed by the long strip main level 21 rising to the long strip vertical rise 22 and then to the long strip upper level 23. The bent end sections rise above sensors on a plane playing surface, when the sensors protrude above the surface of the playing surface. The sensors can be electronic sensors that have infrared beam detection of infrared reflective material on an underside of the long strip 20. As the underside of the long strip 20 passes over the centers, the sensors are triggered on each side without physical contact between the bent end sections and the sensors.

Figure 3:
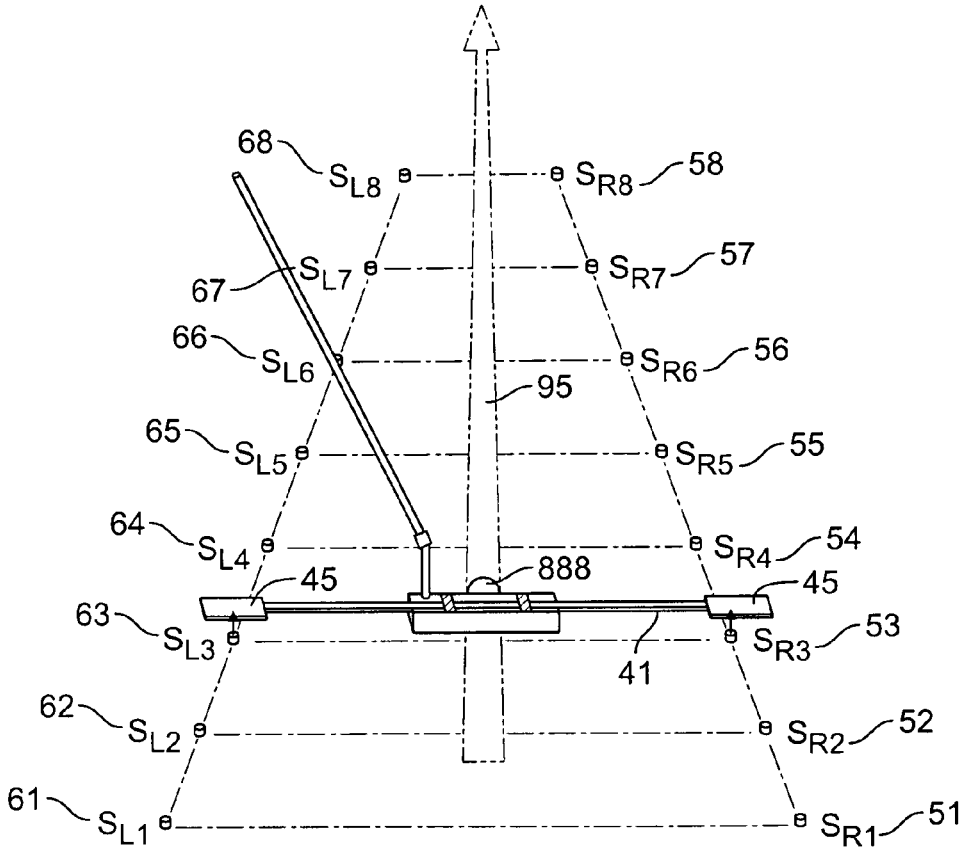
FIG. 3 is rear perspective view diagram of the usage of the present invention.
Figure 4:
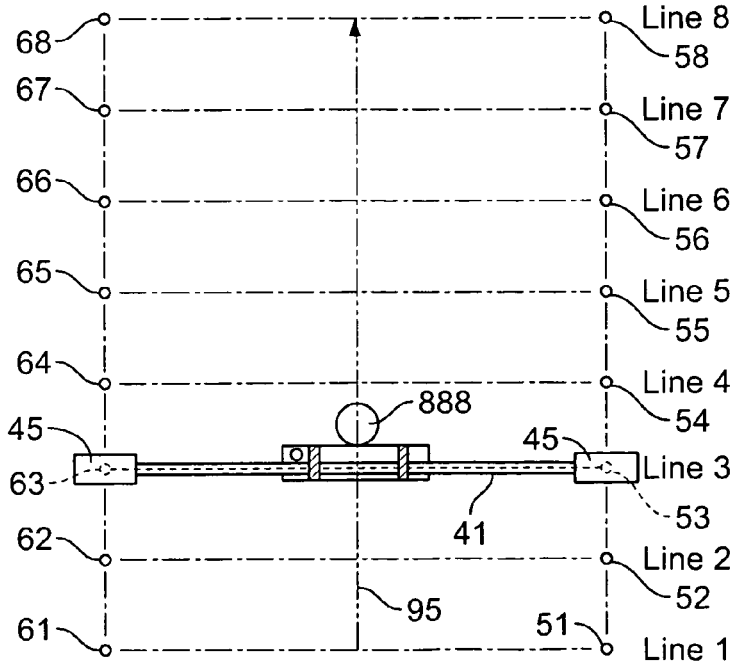
FIG. 4 is a top plan view diagram of the usage of the present invention.

FIG. 3 shows a perspective view of the putter with a strip taped onto the top surface and moving along the target line to trigger the sensors underneath in the motion of a putting swing. FIG. 4 is a top view of the putter showing the median line 95. The median line 95 is the path of the swing which is sometimes straight. The perspective and the top view shows a plurality of sensors on the left side and a plurality of sensors on the right side. The beam sensors are electronic in nature and require voltage for a sensing beam emitted vertically. The right side has a column of sensors denoted as SR1-8 namely, a first right vertical sensor 51, a second right vertical sensor 52, a third right vertical sensor 53, a fourth right vertical sensor 54, a fifth right vertical sensor 55, a sixth right vertical sensor 56, a seventh right vertical sensor 57, and an eighth right vertical sensor 58. The left side has a column of sensors denoted as SL1-8, namely, a first left vertical sensor 61, a second left vertical sensor 62, a third left vertical sensor 63, a fourth left vertical sensor 64, a fifth left vertical sensor 65, a sixth left vertical sensor 66, a seventh left vertical sensor 67, and an eighth left vertical sensor 68. During the swing, the first left and right sensors are activated such that the first row of sensors is activated and then the second row of sensors is activated in sequence through the entire set of sensors from the first row to the eighth row.

Figure 5:
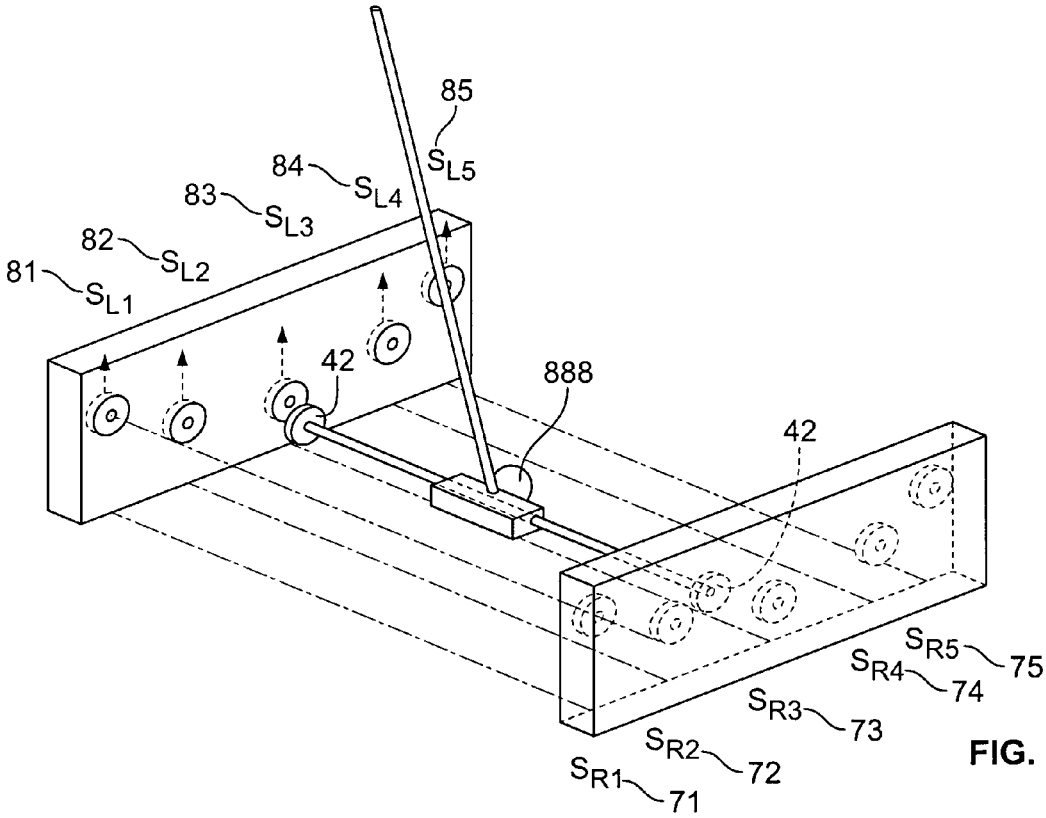
FIG. 5 is a perspective view diagram of the side sensors sidewalls.
Figure 6:
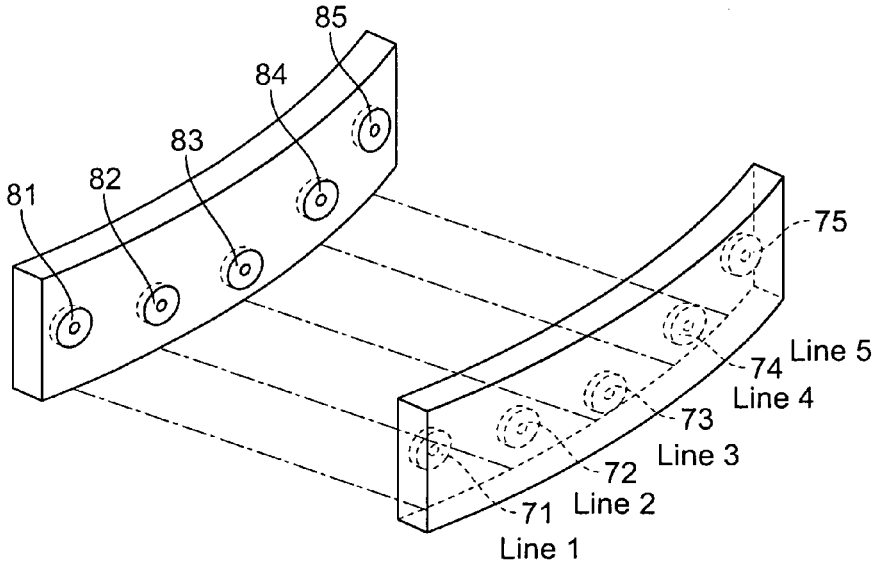
FIG. 6 is a perspective view diagram of the curved side sensors sidewalls.
Figure 7:
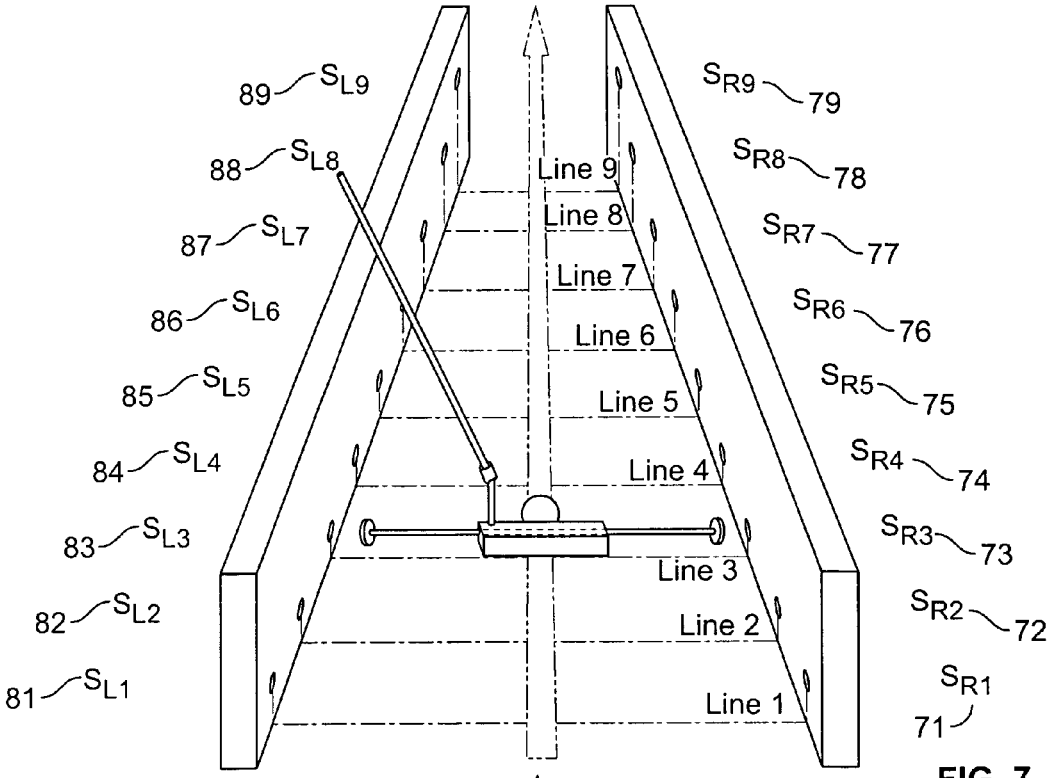
FIG. 7 is a rear perspective view of the side sensors sidewalls.
Figure 8:
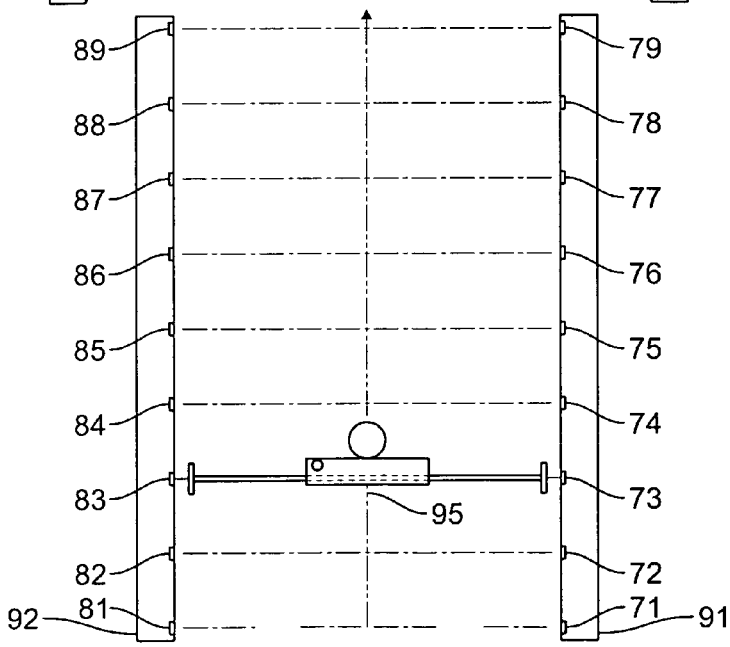
FIG. 8 is a top plan view diagram of the side sensors sidewalls.

The end sections of the long strip can be mounted with round disks attached with highly reflective material to trigger the sensors hanging on the walls. FIG. 5 shows a configuration where the sensors are horizontally mounted for interaction with rod extension horizontal tip members 42. The outside surface of the rod extension horizontal tip members 42 trigger a plurality of horizontal sensors. Since the interaction is occurring horizontally, the set of sensors is defined as SR1-9 of FIGS. 5-8 includes the first right horizontal sensors 71, the second right horizontal sensor 72, the third right horizontal sensor 73, the fourth right horizontal sensor at 74, the fifth right horizontal sensor 75, the sixth right horizontal sensor 76, the seventh right horizontal sensor 77, the eighth right horizontal sensor 78, the ninth right horizontal sensor 79. The set of sensors is defined as SL1-9 of FIGS. 5-8 includes the first left horizontal sensors 81, the second left horizontal sensor 82, the third left horizontal sensor 83, the fourth left horizontal sensor at 84, the fifth left horizontal sensor 85, the sixth left horizontal sensor 86, the seventh left horizontal sensor 87, the eighth left horizontal sensor 88, the ninth left horizontal sensor 89. FIG. 5 shows a view of the putter moving along the target line between the guiding walls of two long blocks with sensors placed at predefined intervals to be triggered by the passing of the round disks on the two ends of the long stick.

Figure 9:
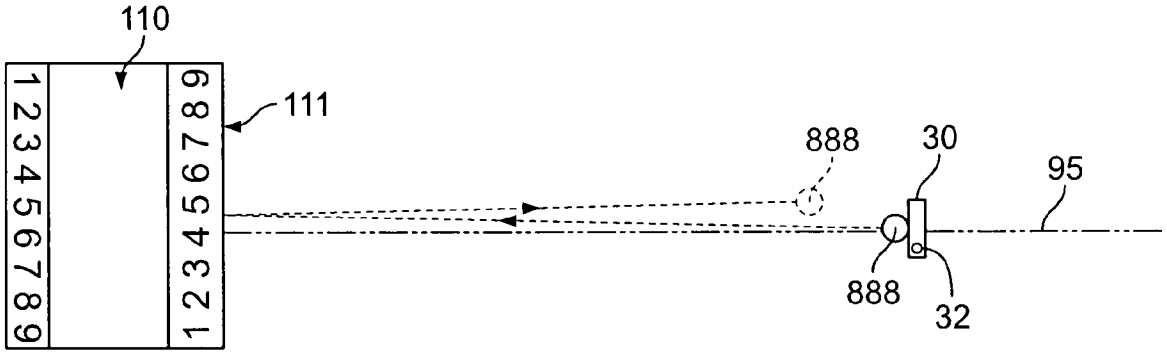
FIG. 9 is a top plan view diagram of the rebound block.
Figure 10:
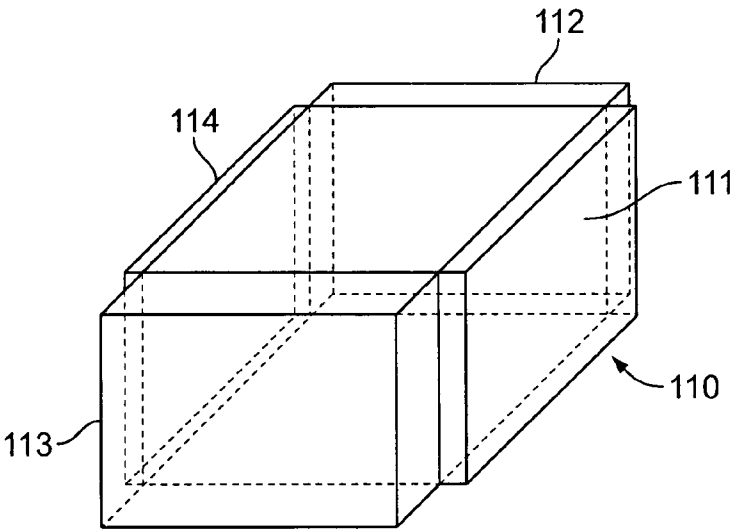
FIG. 10 is a diagram of the rebound block.
Figure 11:
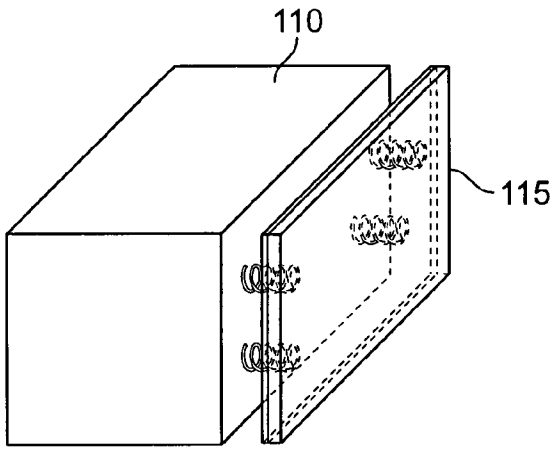
FIG. 11 is a diagram of the spring rebound block.
Figure 12:
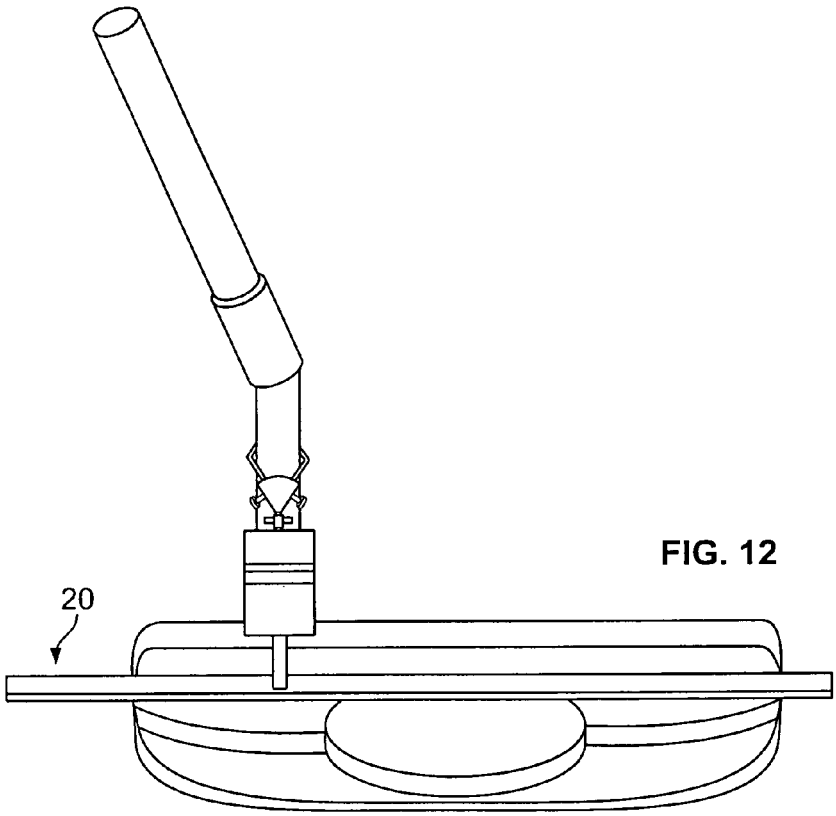
FIG. 12 is a diagram of a clamp connection.

At the end of the course, the ball can be bounced off of a bounce wall which is mounted on a bounce block. FIG. 9, 10 shows how a golf ball bounces back from a bounce wall. FIG. 9, 10 shows four pieces of elastic bouncing plates with different bouncing capabilities attached to the four side surfaces of the high-density weight block in the middle. A rebound block 110 has a first rebound block surface 111, a second rebound block surface 112, a third rebound block surface 113, a fourth rebound block surface 114, and optionally a surface for rebounding can be spring loaded with helical or leaf springs so as to form a spring-loaded rebound block surface 115. The various rebound block surfaces are mounted to the rebound block 110 by rigid connection or by spring connection. The spring bouncing wall may comprise a weight block, four coil springs, a thin hard plate, and an elastic bouncing plate where the four coil springs to add more bouncing capability to the elastic bouncing plate as part of the bouncing plate component.

Generally, the long strip 20 is secured to the putter head. There are a number of ways of securing the long strip 20 to the putter head. Generally, the long strip main level is connected to the putter head by hook and loop tape, glue, or by screws. For a retrofit capability, the long strip 20 can be clamped or clipped to a hosel of the putter to provide a connection. FIG. 12-20 shows more detailed methods to connect the putter with the strip or stick that will either sit on the lower top surface or hang along the side surfaces of the putter.

Figure 13:
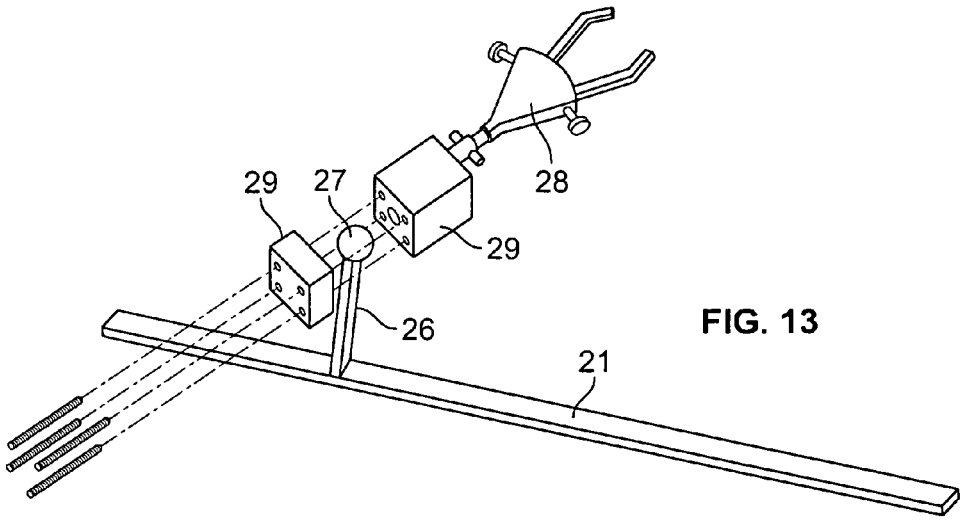
FIG. 13 is an exploded view of a clamp connection.

A clamp can be used for nondestructive retrofit connection. As seen in FIG. 13, the long strip main level includes a long strip post 26 extending from the long strip main level 21. At the end of the long strip post 26 a post ball connector 27 allows and receives a ball clamp 29 for clamping onto the post ball connector 27. The ball clamp 29 includes a hosel clamp 28 formed as a pair of pinching fingers having a left pinching finger and a right pinching finger. Adjustment screws adjust the tension of the pinching fingers. Preferably, a right adjustment screw and a left adjustment screw can adjust the degree of pinch provided by the hosel clamp 28.

Figure 14:
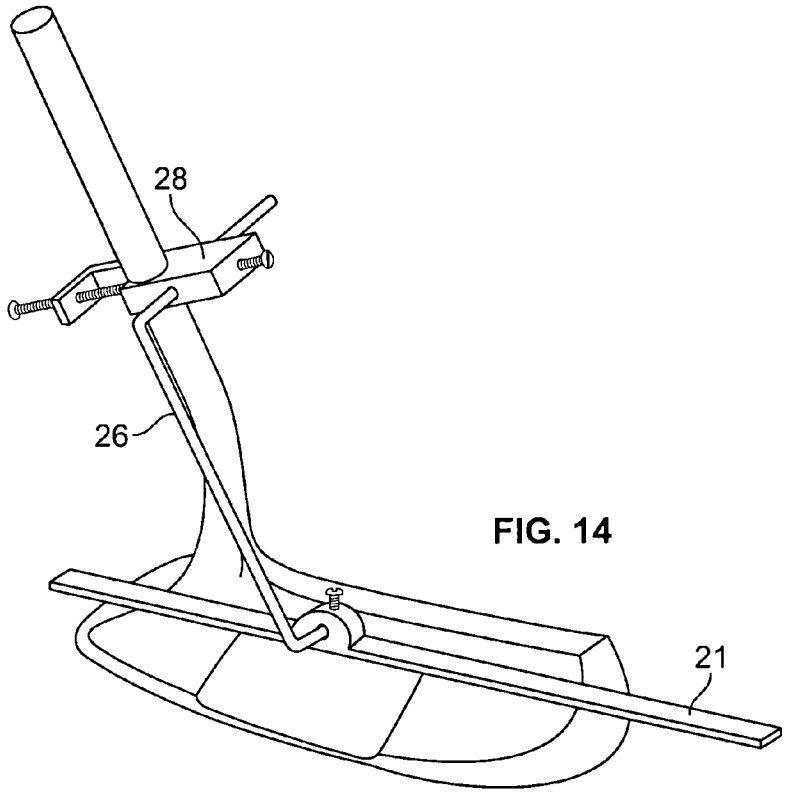
FIG. 14 is a diagram of a clamp connection.
Figure 15:
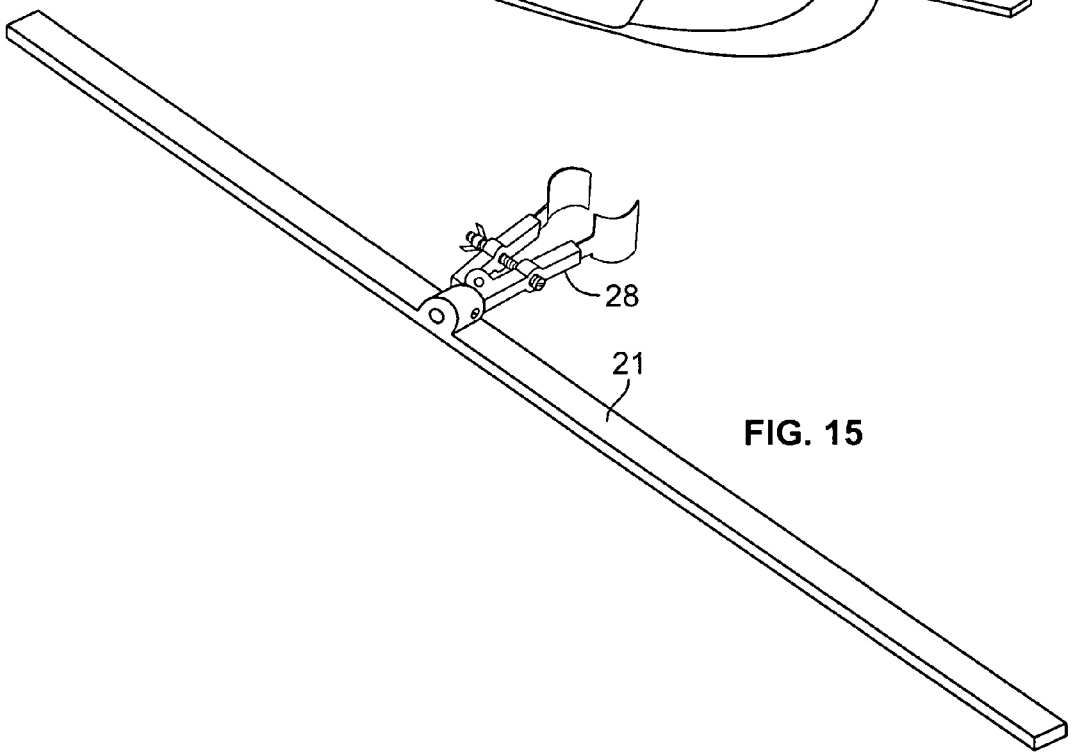
FIG. 15 is a diagram of a forward clamp connection.
Figure 16:
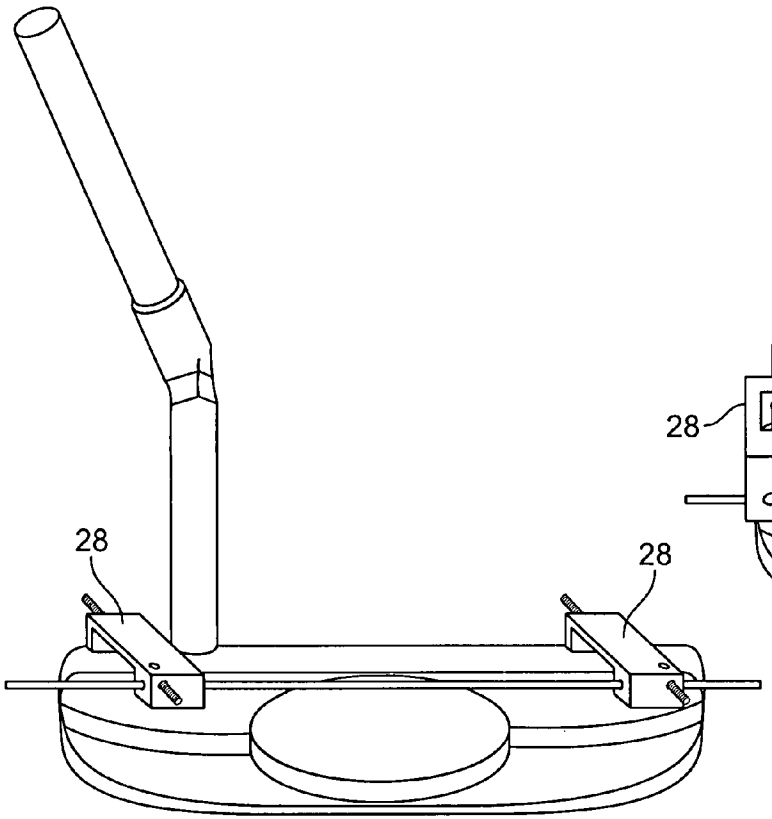
FIG. 16 is a diagram of a double clamp connection.

The clamp can have a variety of configurations. As seen in FIG. 14, the clamp can be horizontal and connect to a location above the hosel with a long strip post that is secured at the clamp by a clamp set screw and secured to the long strip main level by a long strip main level set screw. Alternatively, the clamp 28 can be made as seen in FIG. 15 attached to a midpoint of the long strip main level 21 where the clamp attaches to the hosel which extends from the middle of the putter head. A double clamp is useful, as seen in FIG. 16, 17 where the double clamp connects to the outside of the putter head for connecting a rod 40, or rod extension 41 to the putter head. Using a double clamp requires a left clamp and a right clamp for clamping to a putter head. The rod extension 41 preferably receives a long strip vertical tip member 45 formed as a rectangular flag shaped topper connecting to the end of rod extension 41 by means of a set screw. The long strip 20 can be formed as a stick which is placed along the side surface of the putter and locked to the putter top as shown in FIG. 16, or to the putter sides as shown in FIG. 17.

Figure 17:
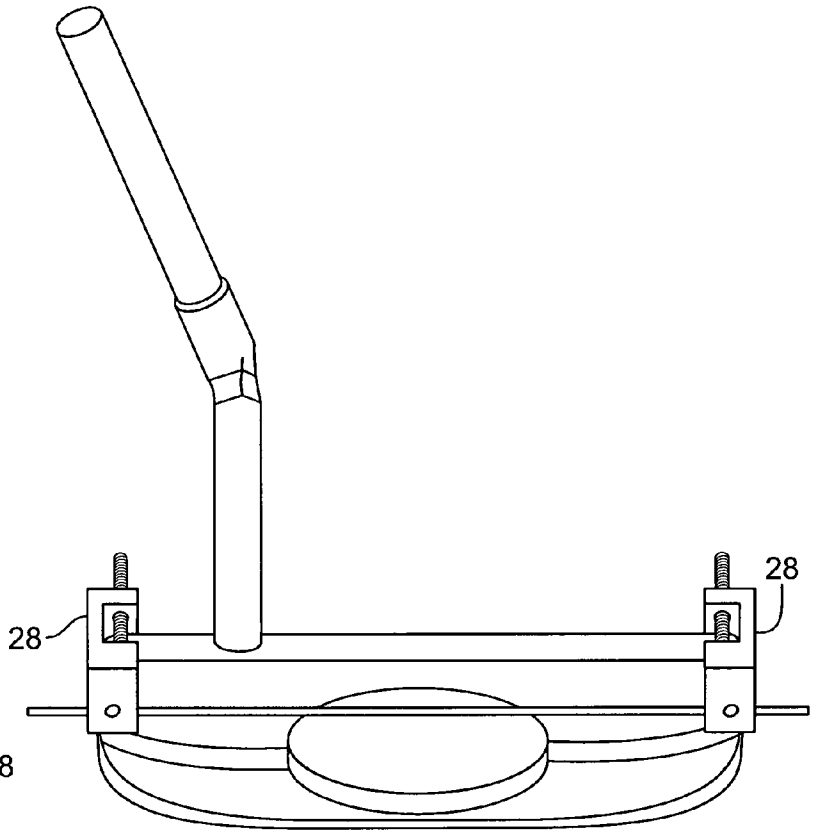
FIG. 17 is a diagram of a double clamp connection.
Figure 18:
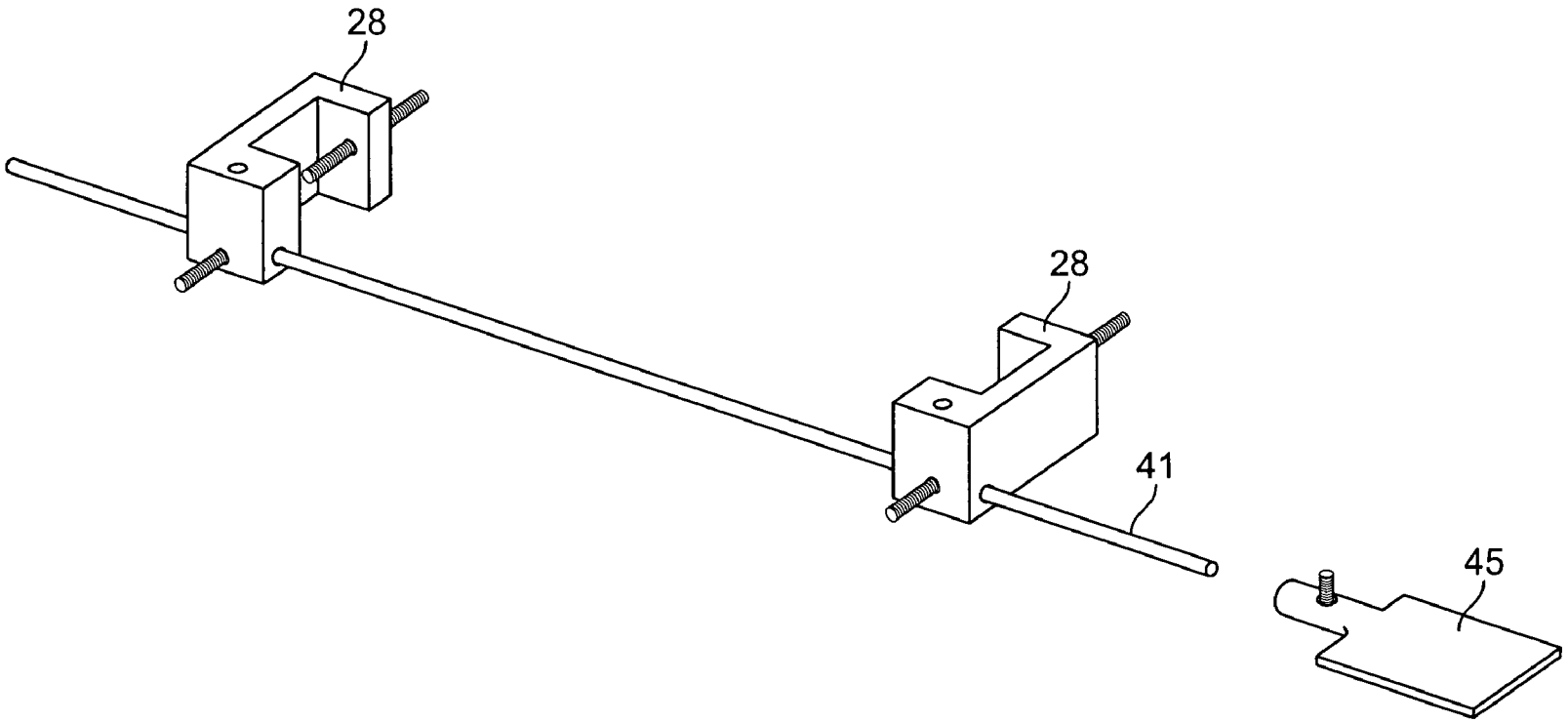
FIG. 18 is an exploded view of a double clamp.
Figure 20:
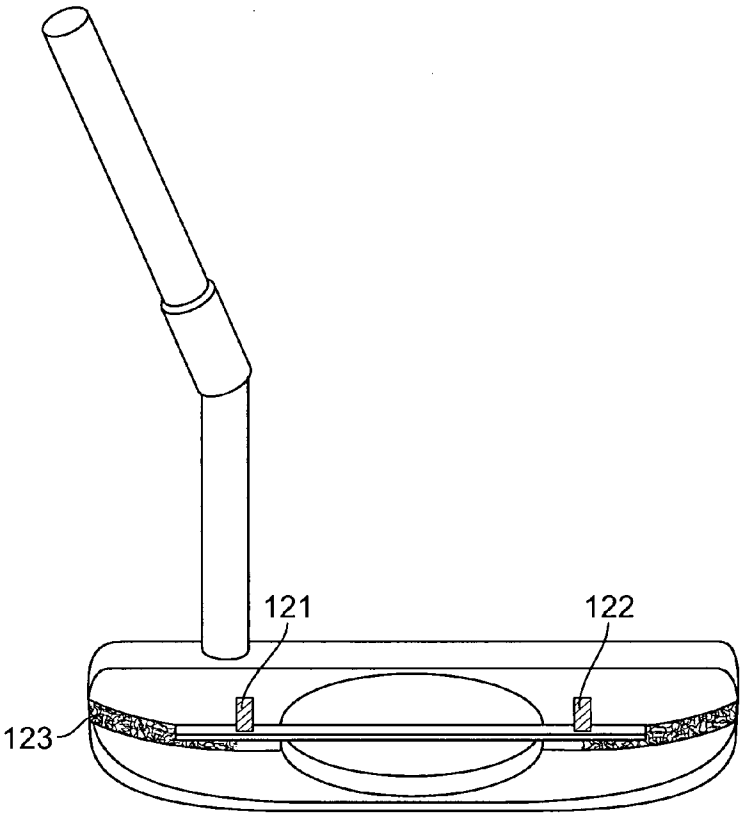
FIG. 20 is a diagram of an adhesive connection.
Figure 19:
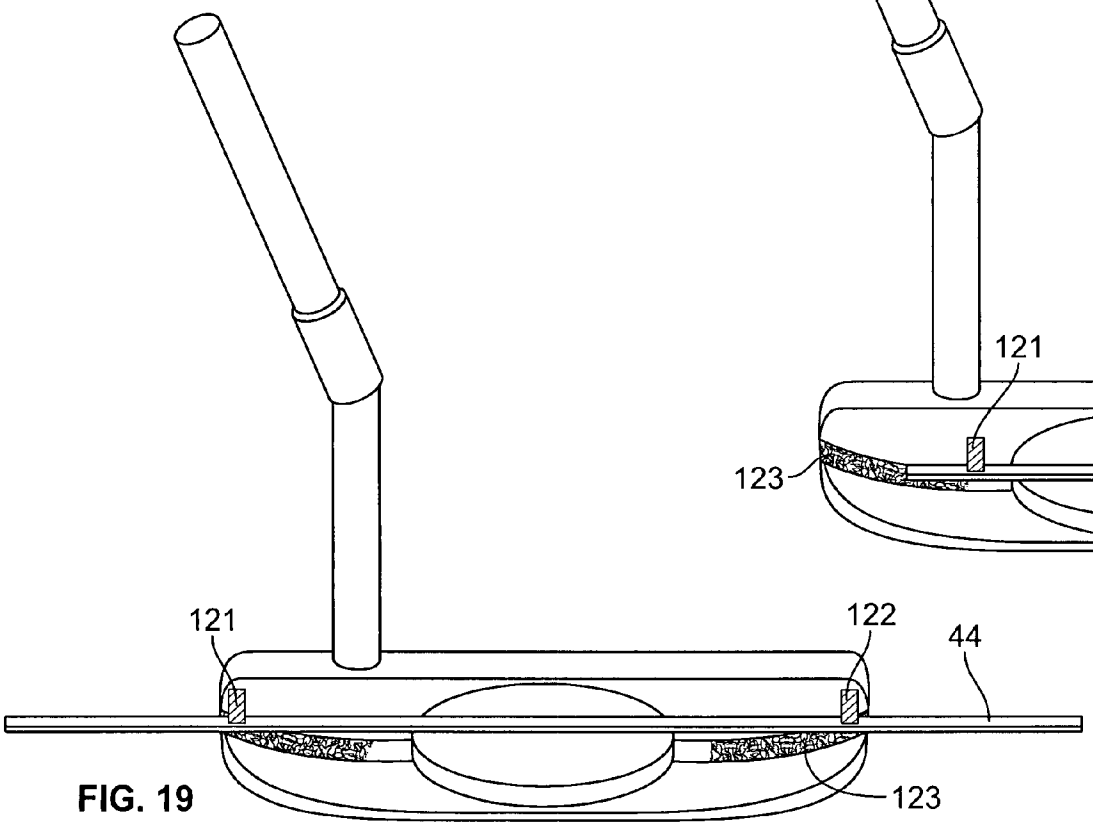
FIG. 19 is a diagram of an adhesive connection.

FIG. 16-17 is the perspective view of the stick (or strip) passing through the two clamps, which are either sitting on the higher top surface or holding on to the two end sections of the higher top surface from the two sides. FIG. 18 is the perspective view of a plate coating with highly reflective material connected to the end section of the stick and locked by a set screw.

Hook and loop tape 123 is also useful for connecting the long strip 20 to the putter head. For example, in FIG. 19-20 the long strip is attached to the top surface or the side surface by tape or hook and loop tape. The long strip can be attached to the top surface of the putter head with hook and loop tape. The long strip first guide 121 can be tape and the long strip second guide 122 can be a second piece of tape used for securing the long strip to the putter head.

Operation of the device is flexible. By properly attaching a long strip 20 or stick to the putter head and placing pairs of sensors on properly chosen locations along or around the target line such as the median line 95. The target line is the line drawn between the target and the golf ball. Watching the long strip 20 and having feedback from the sensors gives the golfer a better sense of the speed of the putter.

There is a pair of striking row sensors placed on the farther and nearer sides of the golf ball to detect the putter face orientation at the contact between the putter and the golf ball. In order to detect the orientation of the putter face at impact, the line connecting the two striking row sensors is perpendicular to the target line. The speed and the orientation of the putter face at the golf ball can be detected by visual and audio signals sent by the pairs of sensors. The orientations of the putter face can also be detected by observing the angles formed between the strip or the stick with the lines connecting each pairs of sensors, assuming these lines are also perpendicular to the target line, especially the striking row pair closest to or at the golf ball because this angle is closely related to the direction of the initial speed of the golf ball. A block of reflective wall made of a type of bouncing material and/or coil spring placed at various distances in front of the golf ball is used to bounce the ball back to the golfer and saves time spent retrieving the golf ball.

The present invention also includes electronics including a central processing unit for receiving input from the sensor. The putting trainer provides two audio and visual feedbacks for the speed and orientation of the club head at the contact with the golf ball. The two visual feedbacks for the speed of the putter head and the orientation of the putter face at the contact with the golf ball are instantaneous and harder to observe. The two audio feedbacks for the speed of the club head and the orientation of the putter face at the contact with the golf ball are delayed audio signals such as musical notes from some electronic devices. The audio signals can be manipulated and made easier to monitor. These audio and visual feedbacks occur before and after the contact between the putter face and the golf ball. The feedback on the right side of or before the golf ball determines the result of the putting. The golfer should analyze the audio and visual feedback before and at the contact between the clubface and the golf ball to make the correction for the next putting. If the golfer makes a nice putt, he or she can try to repeat the same audio and visual feedback pattern to develop the muscle memory of that stroke so that it can be repeated on the green of the golf course. A reflective wall of different bouncing materials and/or coil spring for different bouncing capability will return the ball back to the golfer at different putting distances to save the retrieving time and make the game fun and possible to play in a small space.

The best modes of the present invention are stated above. Other modes include making the sensors adjustable in position and used as follows: The golf ball can also be placed on top of the target line which connects the target and the golf ball. The putter is moving along the target line to drive the ball toward the target. Two arrays of sensors such as left array of SL1 and SL2 till SL6 and right array of SR1, SR2 till SR6) can be lined up on both sides of and parallel to the target line. The lines (such as the Line 1, Line 2 till line 6) connecting each pair of the sensors on the left and right sides of the target line such as the pair (SL1, SR1), pair (SL2, SR2) . . . and pair (SL6, SR6) are preferably perpendicular to the target line and shown on the ground. The distances between each pair of adjacent lines (such as the distance between Line 1 and Line 2, Line 2 and Line 3, Line 5 and Line 6) are equal so that the musical notes of the sound pattern generated by the triggered sensors will have a more orderly rhythm to be analyzed. DR is the distance between the target line and the sensors on the right side of the target line. DL is the distance between the target line and the sensors on the left side of the target line. The distance of (DR+DL) is slightly shorter than the length of the strip with two raised end sections which will trigger the sensors underneath as the putter moves along the target line. In general DR and DL are equal or close in value. The majority of the length of a strip in the central portion moves closer to the ground and thus makes the orientation of the moving putter face (which is parallel to the length of the strip) easier to be monitored by comparing the orientation of the strip with the orientation of each individual line such as Line 1, Line 2, Line 6 as shown on the ground.

The orientation variation of the putter face along the target line is related to the angle variation formed between the putter face with respect to Line 1, Line 2, and Line 6 which is equal to the angle variation pattern during the swing and is related to the direction of the driven golf ball. Angle variation is accentuated in slower putting when the distance between the putter and the target is shorter. Among these six angles, the third angle formed between the long strip and Line 3 is the most important. Because the sensors are carefully placed in such a manner that at the moment that contact between the putter face and the golf ball occurs, if the strip overlaps with the Line 3 and the line 3 disappears, the putter face is square with the target line and driven golf ball will move toward the target. In the meantime, when Line 3 becomes invisible, the sensors SL3 and SR3 will be triggered at the same time and the sound signals produced by the two sensors will be sounded simultaneously to produce one combined sound signal. If there are two sound signals produced by sensors SL3 and SR3, it implies the putter face is not square with the target line. The time internal between the two sound signals is proportional to the deviation of the orientation of the putter face or the strip from the Line 3 which is perpendicular to the target line. The deviation of the orientation of the putter face or the strip from the line 3 is equal to the deviation of the normal of the putter face from the target line. The normal of the putter face is the direction along which the golf ball will be driven.

The order of the triggering or the triggered sound signal generated by the sensors SL3 and SR3 will show which direction the golf ball will move. For example if the SR3 is triggered first and the SL3 is triggered second, then the golf ball will move to the left side of the target line. On the other hand, if the SL3 is triggered first and the SR3 triggered second, then the golf ball will move to the right side of the target line. With the visual and audio feedback's help, the golfer would be able to analyze what kind of adjustment to make for the next putting swing. The muscle memory practice for the putter to meet the golf ball square is to swing the putter to produce a sound pattern where the musical notes generated by the sensors SL3 and SR3 will sound out as close as possible and the Line 3 should be seen as little as possible. This audio feedback practice is made easier and more effectively with all of the sensors removed or turned off except for sensors SL3 and R3. The sensors may be connected to a microprocessor so that the interval of two sound signals from SL3 and SR3 can be lengthened and made easier to listen. For example there may be a dial with setting of 10, 20, 30 . . . 100 so that the putter can choose to lengthen the interval of the two sound signals by 10, 30, 30 . . . 100 times. The visual feedback of the speed of the ball is shown by how fast the golf ball moves after the swing so that the golfer can make a correction for the next putt. On the other hand, the speed of the golf ball is proportional to the tempo of the sound pattern generated by the putting before the contact between the putter and the golf ball so that the golfer can practice and build muscle memory by repeating the tempo of the musical pattern of a decent putt. This can be done with or without the presence of the golf ball. In theory, the result of a putting is determined by the audio feedback of the triggered sensors and visual feedback from the angle variation formed between the strip and the lines connecting the pairs of sensors on the right side (or a right hander) of the golf ball. The added sensors on the left side or behind the golf ball serves to add more sound signals or musical notes to the sound pattern whose tempo represents the speed of the golf ball.

A long strip taped on the top surface of the putter head moving along the target line and triggering the sensors under the strip produce a visual and audio feedback. The strip with expanded end sections triggers the sensors when passing over them to produce a sound pattern which provides information of the space and orientation of the putter face along a certain segment of the putting curve around the golf ball. The sensors are placed at chosen spots along the putter path by design so that the putter can trigger every sensor in the putting stroke, repeat the same putting movement and get the same sound pattern to build up the muscle memory for the putting of a certain distance. The end result is to see how close the golf ball will follow the same path and reach the intended target.

The putting movement is also monitored by the visual pattern formed by the long strip versus the line connecting each pair of sensors around the golf ball. One particular and most important picture to note is the one depicting that the long strip will overlap with and cover up Line 3 at the moment the putter meets the golf ball so that the putter face is square with the target line and the golf ball will move toward the target.

The stick can be sitting inside the putter head with two round disks attached to the two end sections. The highly reflective material is attached to the disks are designed to trigger the sensors hanging on the inner surfaces of the wall of two long blocks. The sensors shown as SR1, SR2, SR3, SR4, SR5, SL1, SL2, SL3, SL4, and SL5 are placed in the properly chosen spots to be triggered by the disks as the putter moves along the target line between the walls of the two blocks. The goal is to have the golfer repeat the putting stroke with the same audio and visual feedback to build muscle memory for each different distance. The walls of the two blocks also serve as a visual guide for the putter head to follow. Walls can be curved such that two bent blocks instead of the straight ones can be used for some bending putting curve. The amount of the bending of the walls can be adjusted according to a height of the golfer.

A stick can be placed inside the putter head with two disk shaped end sections attached with highly reflective material to trigger the sensors hanging on the wall of two blocks.

A golf ball and a rebounding reflective wall can have two different elastic bouncing plates. After a decent putting stroke, the golf ball will move closely along the target line to meet the reflective wall and bounce back with a very small reflective angle to a point close to but a little short from the original point. In this case, the target line is the line drawn from the golf ball to the reflective wall with the shortest distance or at a right angle. The golfer can repeatedly hit the golf ball to bounce off the reflective wall and return to the original starting point of the golf ball with varying distance between the reflective wall and the golf ball. Since the returning point is slightly shorter, the putter will launch another stroke with slightly more power and adjustment of the orientation and the ball will move along the target line to return closer to the starting point. By changing the distance between the wall and the golf ball, the golfer can learn to control the putting with different pace or power. The golfer can arrange two or more reflective walls for the golf ball to bounce off and reach a pre-planned target point for a more complicated and fun game.

The reflective wall may consist of two parts of different functions. The front part facing the golf ball is a bouncing plate made of lighter material with different bouncing capabilities (and springs). The rear part of the reflective wall is a weight block, which is made of high-density material to back up the front part and sustain heavy pounding from the golf ball without moving. There can be two elastic bouncing plates of different bouncing capabilities on the opposite sides of the weight block. There can be four elastic bouncing plates of different thickness or materials attached to the four sides of the weight block to provide four different bouncing capabilities. The bouncing plate component of the reflective wall includes a coil spring connected to a light hard plate on which an elastic bouncing plate is attached to enhance the bouncing capability of the reflective wall. The more bouncy materials may be used in a larger area, which allows the ball to move a longer distance with a softer stroke. The less bouncy materials may be used in a small area in which there is enough room for the ball to bounce around even if the putting stroke is heavier.

The best mode for attaching a long strip to the top or side surface of the putter is to use ordinary adhesive tools such as glue, adhesive tape such as single sided or double sided adhesive tape according to golfer's preference, or hook and loop tape. The adhesives can be applied to a putter of any shape and material. If the putter is made of ferromagnetic material, a long or short strip with a small magnet implanted or attached will be a good attachment tool. A moveable implanted magnet inside a slot in the strip may help increase the attaching strength in ferromagnetic putter head of different shape and structure by placing the magnet at the properly chosen spot. The disadvantage of a magnet is that the additional weight of the heavier metallic magnet may affect the balance of the putter head.

A long strip can be attached to the lower top surface by hook and loop tape attached to the bottom of the strip and top of the lower top surface. The long strip is also attached to the side surface by adhesive tape. The long strip is used to provide visual and audio feedbacks by triggering the pairs of electronic sensors along the target line when practice is indoors. The shorter strip is also attached to the lower top surface of the putter in the same fashion. Regardless of the long strip weight plus its attachment tool weight, it can be replaced by a short strip of properly chosen shape and material such as metal, wood, or plastic plus its attachment tool of the same weight on the golf green, so that the golfer will swing with a putter head of the same total weight or moment of inertia. On the golf green, an ordinary shaped putter with an attached shorter strip may replace the practice putter with a long strip used in practice indoors.

Other methods of connecting the putter with the strip or stick will sit on the top surfaces or hang along the side surface of the putter. An adjustable angle Burette clamp can connect the long strip to the shaft of the putter. The ball joint is sitting and turning in between two partial ball shaped sockets, which are connected by four long screws. When the long strip is adjusted to be parallel to the length of the clubface and the top surface, the four screws will be tightened to hold the long strip firmly for practice indoors.

The long strip preferably sits along the side surface of the putter and connects to the putter through two clamps locking to the higher top surface from above. The long strip may also sit along the side surface of the putter and connects to the putter through two clamps sitting on the lower top surface and locked to the higher top surface at the two end sections from the side.

The foregoing has outlined, in general, the physical aspects of the invention and is to serve as an aid to better understand the more complete detailed description which is to follow. In reference to such, there is to be a clear understanding that the present invention is not limited to the method or detail or construction, fabrication, material, or application of use described and illustrated herein. Any other variation of fabrication, use, or application should be considered apparent as an alternative embodiment of the present invention.

The invention claimed is:

1. A putting trainer comprising:

a. a golf putter having a handle, a shaft connected to the handle, a hosel connected to the shaft and a putter head connected to the hosel;

b. a long strip mounted to the head along a length of the putter head, wherein the long strip has a pair of ends, namely a close end toward the player and a far end away from a player;

c. a ball path having a pair of columns of sensors, namely a column of right sensors and a column of left sensors, wherein the pair of columns of sensors detect the motion of the long strip over the pair of columns of sensors; and d. an audio output from a speaker, wherein the audio output provides feedback to the player; and e. a rebound block having at least two faces, namely a first face, a second face, wherein the first face has high bounce back surface, and a second face with a low bounce back surface.

2. The putting trainer of claim 1, wherein the long strip is formed with a rectangular cross-section so that the long strip is bar shaped.

3. The putting trainer of claim 2, wherein the long strip has a pair of outwardly facing horizontally oriented long strip vertical members mounted at a left and right end of the long strip, wherein the pair of columns of sensors is vertically oriented and mounted on a horizontal surface, wherein the pair of columns of sensors senses the pair of outwardly facing horizontally oriented long strip vertical members when the pair of outwardly facing horizontally oriented long strip vertical members pass the pair of columns of sensors.

4. The putting trainer of claim 3, further comprising a long strip plug of the same length as the putter head, and flush with the putter head when the long strip plug replaces the long strip.

5. The putting trainer of claim 3, wherein the pair of outwardly facing vertical oriented long strip horizontal members are flag shaped.

6. A putting trainer comprising:

f. a golf putter having a handle, a shaft connected to the handle, a hosel connected to the shaft and a putter head connected to the hosel;

g. a long strip mounted to the head along a length of the putter head, wherein the long strip has a pair of ends, namely a close end toward the player and a far end away from a player;

h. a ball path having a pair of columns of sensors, namely a column of right sensors and a column of left sensors, wherein the pair of columns of sensors detect the motion of the long strip over the pair of columns of sensors; and i. an audio output from a speaker, wherein the audio output provides feedback to the player, wherein the long strip is mounted to the golf putter at a top slot formed on a top surface of a putter head, wherein the top strip fits into the top slot and is removably secured within the top slot, wherein the long strip is formed with a rectangular cross-section so that the long strip is bar shaped, wherein the long strip has a pair of outwardly facing horizontally oriented long strip vertical members mounted at a left and right end of the long strip, wherein the pair of columns of sensors is vertically oriented and mounted on a horizontal surface, wherein the pair of columns of sensors senses the pair of outwardly facing horizontally oriented long strip vertical members when the pair of outwardly facing horizontally oriented long strip vertical members pass the pair of columns of sensors.

7. The putting trainer of claim 6, further comprising a long strip plug of the same length as the putter head, and flush with the putter head when the long strip plug replaces the long strip.

8. The putting trainer of claim 6, wherein the pair of outwardly facing vertical oriented long strip horizontal members are flag shaped.

9. A putting trainer comprising:

a. a golf putter having a handle, a shaft connected to the handle, a hosel connected to the shaft and a putter head connected to the hosel;

b. a long strip mounted to the head along a length of the putter head, wherein the long strip has a pair of ends, namely a close end toward the player and a far end away from a player;

c. a ball path having a pair of columns of sensors, namely a column of right sensors and a column of left sensors, wherein the pair of columns of sensors detect the motion of the long strip over the pair of columns of sensors; and d. an audio output from a speaker, wherein the audio output provides feedback to the player; and e. wherein the long strip is formed with a round cross-section so that the long strip is rod shaped, wherein the long strip is mounted to the golf putter at a rod retainer opening passing through the putter head.

10. A putting trainer comprising:

a. a golf putter having a handle, a shaft connected to the handle, a hosel connected to the shaft and a putter head connected to the hosel;

b. a long strip mounted to the head along a length of the putter head, wherein the long strip has a pair of ends, namely a close end toward the player and a far end away from a player;

c. a ball path having a pair of columns of sensors, namely a column of right sensors and a column of left sensors, wherein the pair of columns of sensors detect the motion of the long strip over the pair of columns of sensors; and d. an audio output from a speaker, wherein the audio output provides feedback to the player; and wherein the long strip has a pair of outwardly facing vertical oriented long strip horizontal members mounted at a left and right end of the long strip, wherein the pair of columns of sensors is horizontally oriented and mounted on a vertical surface, wherein the pair of columns of sensors senses the pair of outwardly facing vertical oriented long strip horizontal members when the pair of outwardly facing vertically oriented long strip horizontal members pass the pair of columns of sensors.

11. A putting trainer comprising:

a. a golf putter having a handle, a shaft connected to the handle, a hosel connected to the shaft and a putter head connected to the hosel;

b. a long strip mounted to the head along a length of the putter head, wherein the long strip has a pair of ends, namely a close end toward the player and a far end away from a player;

c. a ball path having a pair of columns of sensors, namely a column of right sensors and a column of left sensors, wherein the pair of columns of sensors detect the motion of the long strip over the pair of columns of sensors;

d. an audio output from a speaker, wherein the audio output provides feedback to the player; and e. a rod extension plug of the same length as the putter head, and flush with the putter head when the rod extension plug replaces the long strip in the rod retainer opening.

12. A putting trainer comprising:

a. a golf putter having a handle, a shaft connected to the handle, a hosel connected to the shaft and a putter head connected to the hosel;

b. a long strip mounted to the head along a length of the putter head, wherein the long strip has a pair of ends, namely a close end toward the player and a far end away from a player;

c. a ball path having a pair of columns of sensors, namely a column of right sensors and a column of left sensors, wherein the pair of columns of sensors detect the motion of the long strip over the pair of columns of sensors; and d. an audio output from a speaker, wherein the audio output provides feedback to the player; and e. wherein the long strip is mounted to the golf putter by hook and loop tape to a top surface of the putter head, wherein the long strip has a pair of outwardly facing horizontally oriented long strip vertical members mounted at a left and right end of the long strip, wherein the pair of columns of sensors is vertically oriented and mounted on a horizontal surface, wherein the pair of columns of sensors senses the pair of outwardly facing horizontally oriented long strip vertical members when the pair of outwardly facing horizontally oriented long strip vertical members pass the pair of columns of sensors.

13. The putting trainer of claim 12, further comprising a rebound block having at least two faces, namely a first face, a second face, wherein the first face has high bounce back surface, and a second face with a low bounce back surface.

* * * * *